US007669576B2

(12) United States Patent
Muramatsu

(10) Patent No.: US 7,669,576 B2
(45) Date of Patent: Mar. 2, 2010

(54) LUBRICATING APPARATUS FOR 4-CYCLE ENGINE

(75) Inventor: Hitoshi Muramatsu, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 380 days.

(21) Appl. No.: 11/751,466

(22) Filed: May 21, 2007

(65) Prior Publication Data

US 2007/0272193 A1 Nov. 29, 2007

(30) Foreign Application Priority Data

May 26, 2006 (JP) ..... 2006-146997
Feb. 16, 2007 (JP) ..... 2007-036582

(51) Int. Cl.
*F01M 1/02* (2006.01)
*F02B 77/00* (2006.01)

(52) U.S. Cl. ..... 123/196 R; 184/6.5; 123/195 C

(58) Field of Classification Search ..... 123/195 R, 123/195 C, 195 H, 196 CP, 198 E, 198 DA, 123/196 R; 184/6.5; 220/4.14, 905
See application file for complete search history.

(56) References Cited

U.S. PATENT DOCUMENTS 5,467,843 A * 11/1995 Esch et al. ..... 184/6.5
6,729,292 B1 * 5/2004 Bock et al. ..... 123/195 C
2008/0245613 A1 * 10/2008 Rutschmann et al. ..... 184/6.5

FOREIGN PATENT DOCUMENTS

JP 60-224916 * 9/1985
JP 08-049596 2/1996
WO WO 2006/000269 A1 * 1/2006

* cited by examiner

*Primary Examiner*—Noah Kamen
(74) *Attorney, Agent, or Firm*—Keating & Bennett, LLP

(57) ABSTRACT

An oil chamber of an oil pan 6 divided into a main oil chamber that collects oil from a crankcase and an auxiliary oil chamber that is positioned adjacent to the main oil chamber. The main oil chamber is connected with an oil supply pump that supplies oil to lubricated sections of an engine and the auxiliary oil chamber is connected with an oil collecting pump that returns oil to the main oil chamber.

40 Claims, 9 Drawing Sheets

[FIG. 1]
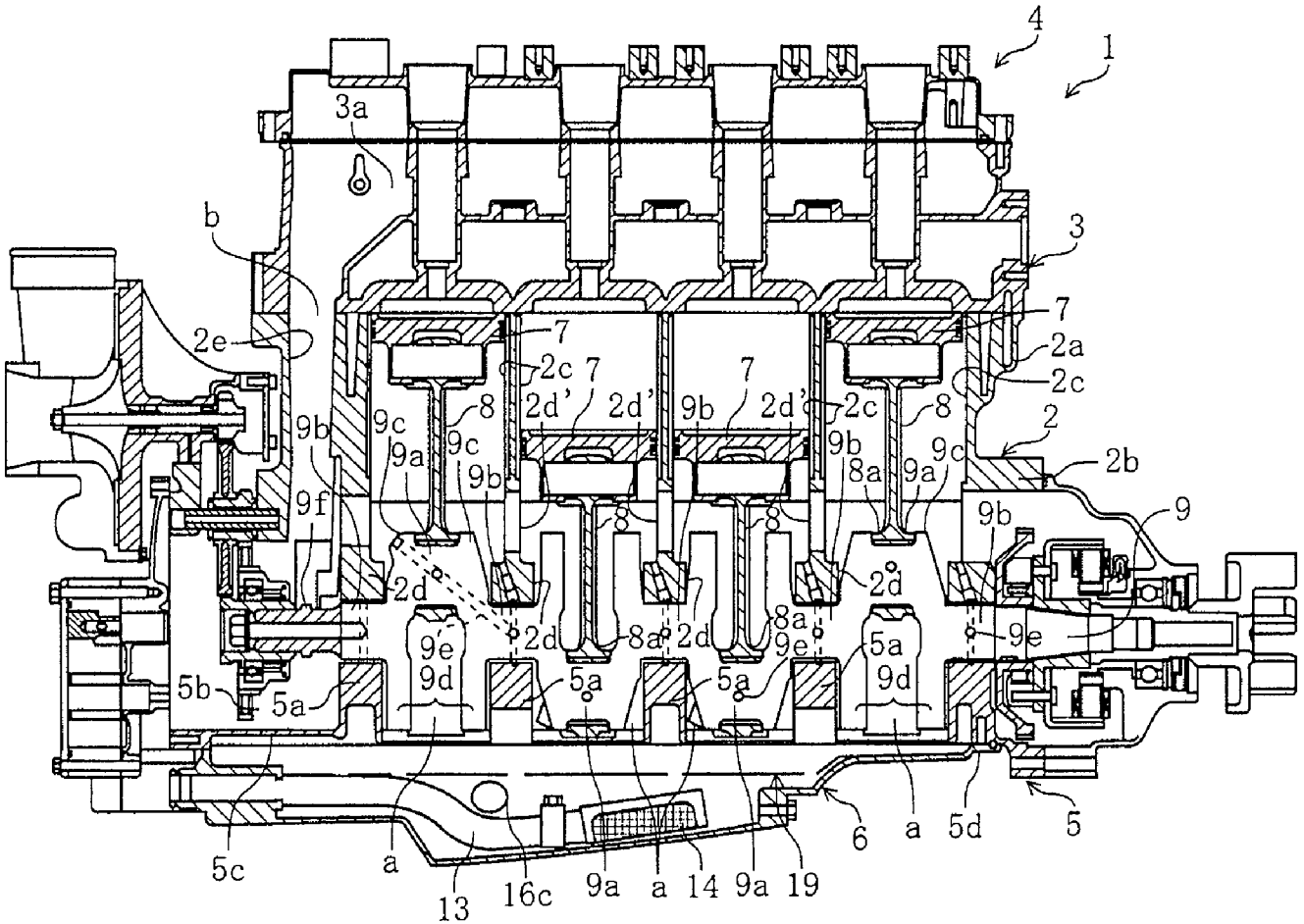

[FIG. 2]
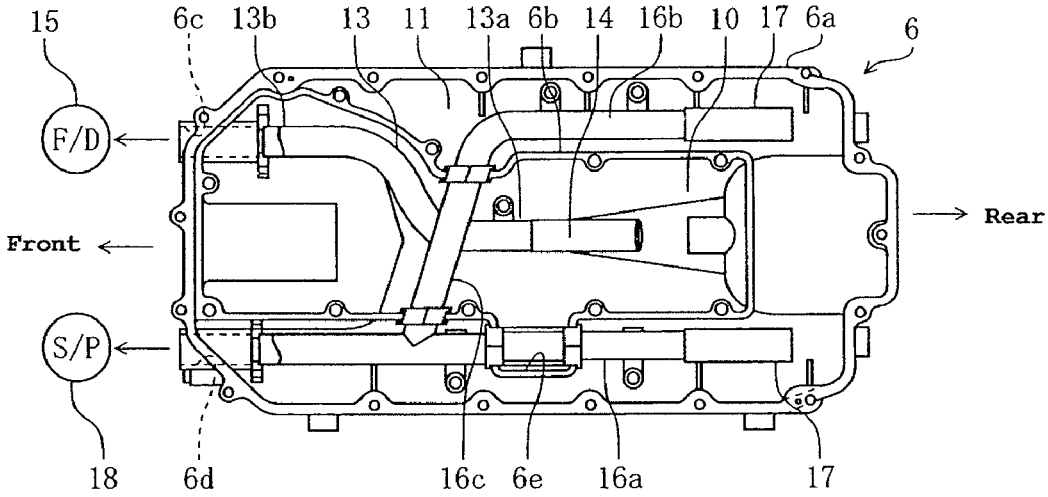
[FIG. 3]
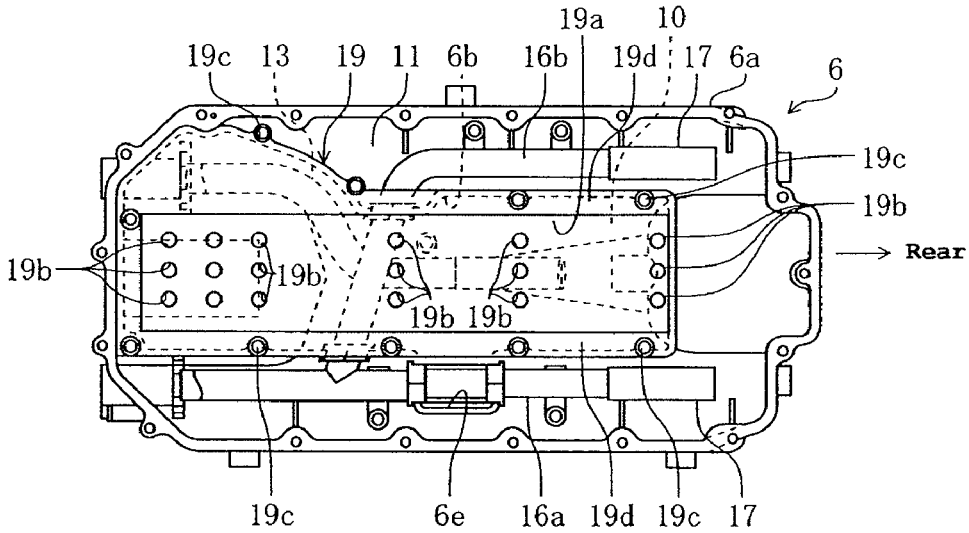

[FIG. 4]
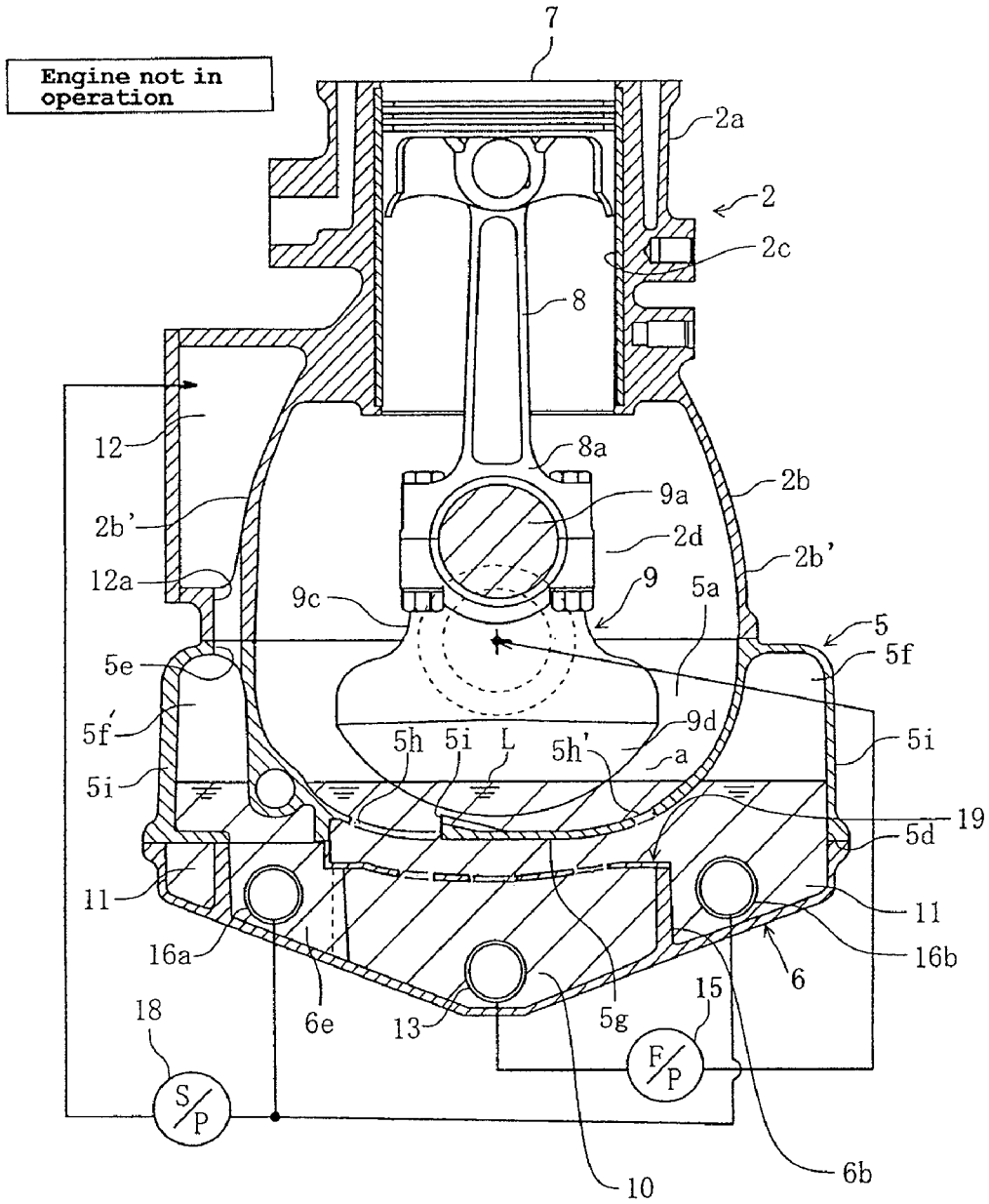

[FIG. 5]
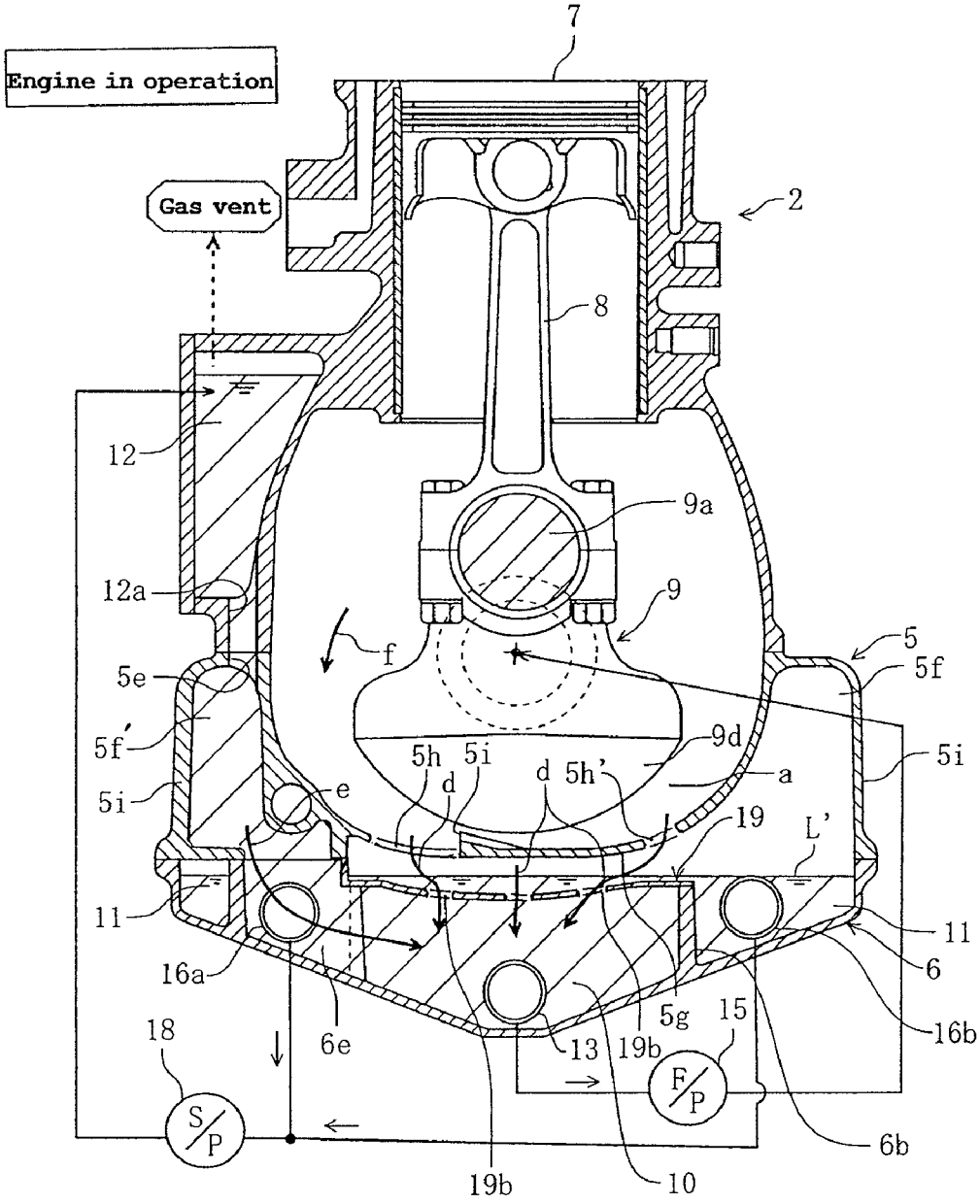

[FIG. 6]
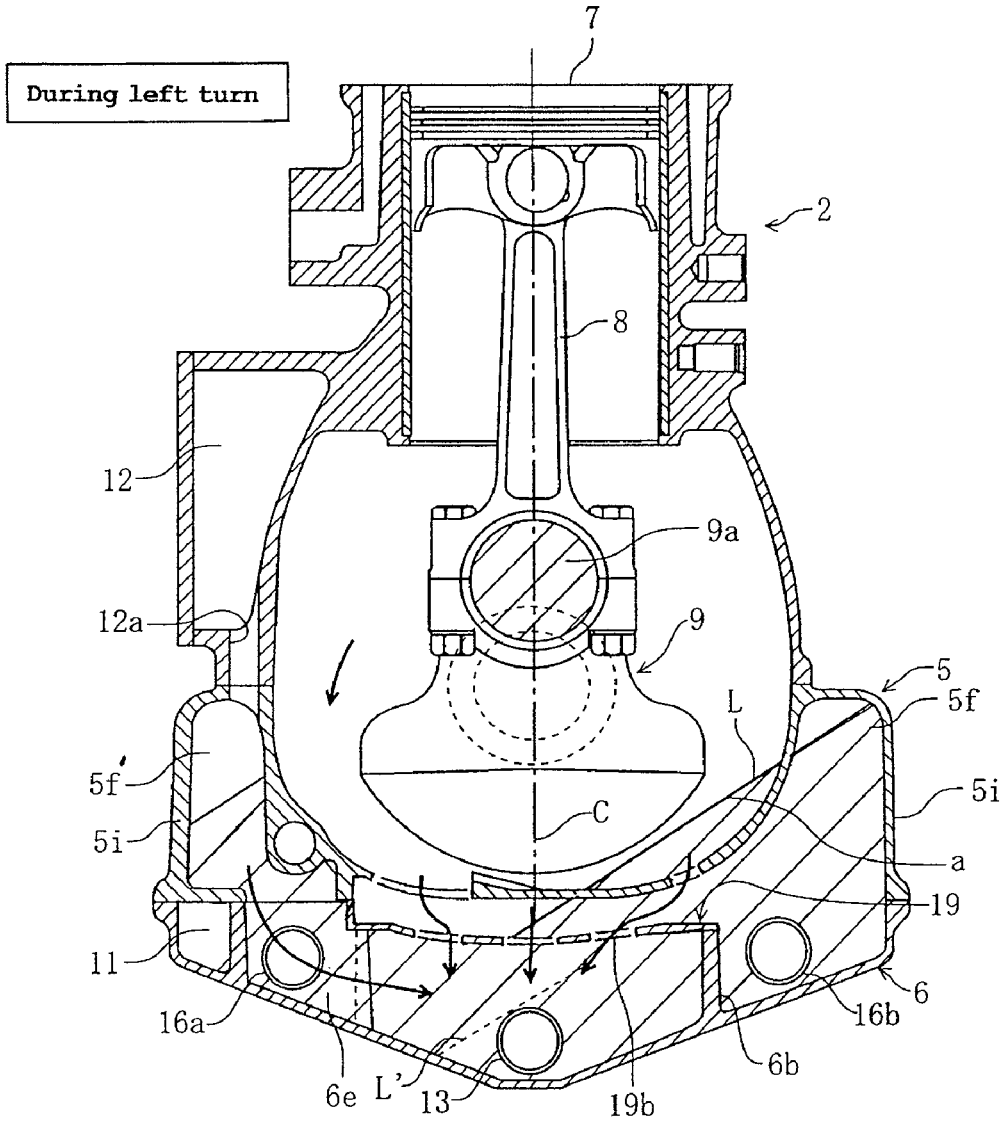

[FIG. 7]
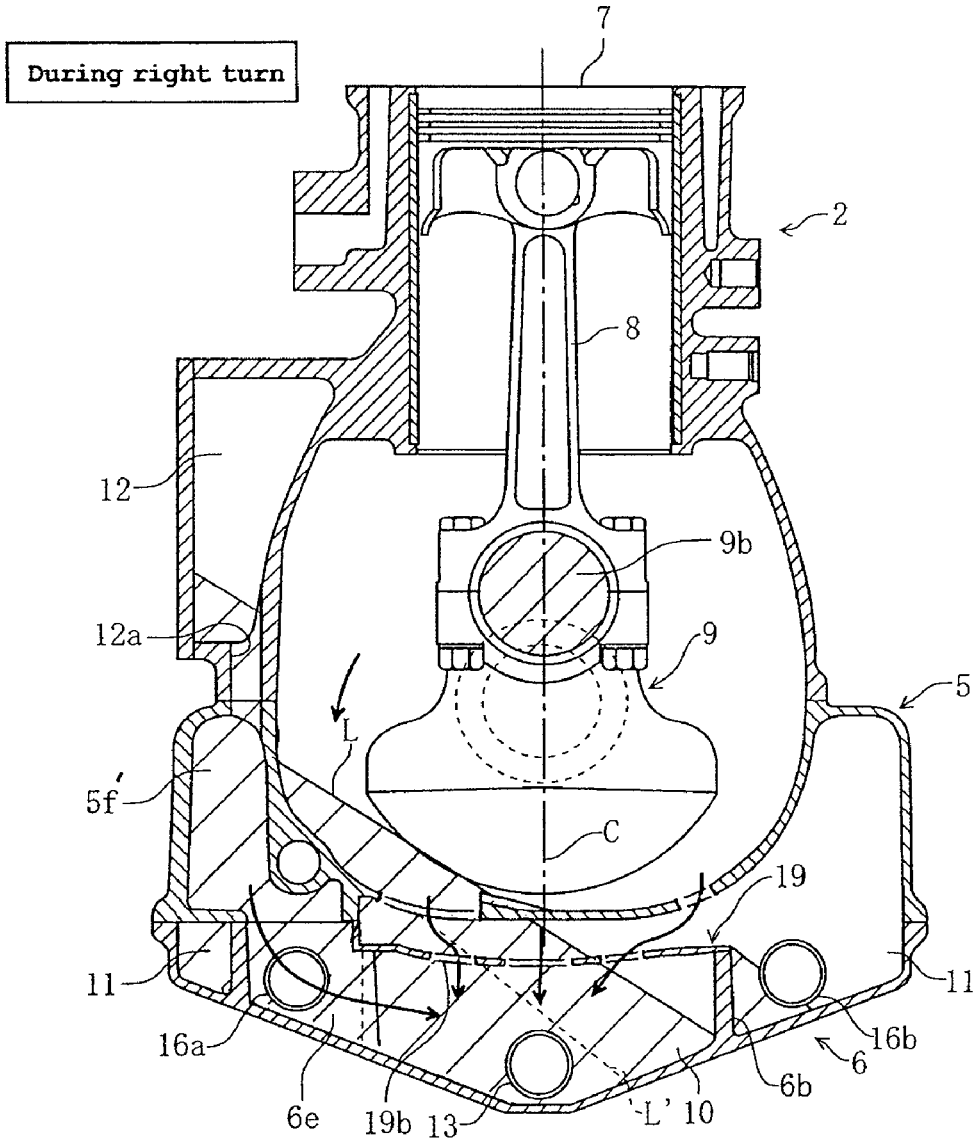

[FIG. 8]
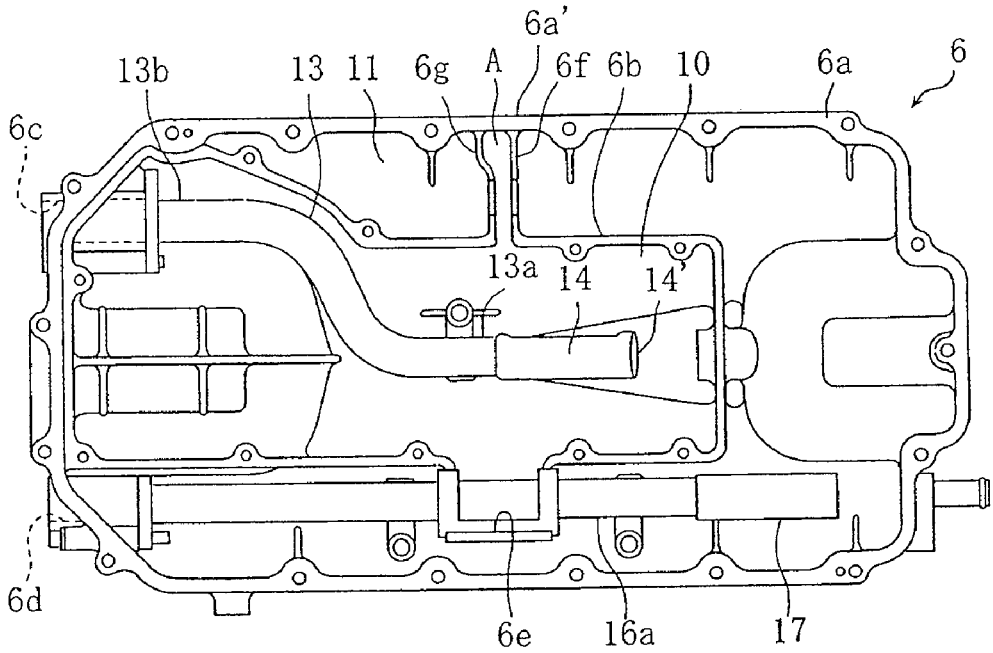
[FIG. 9]
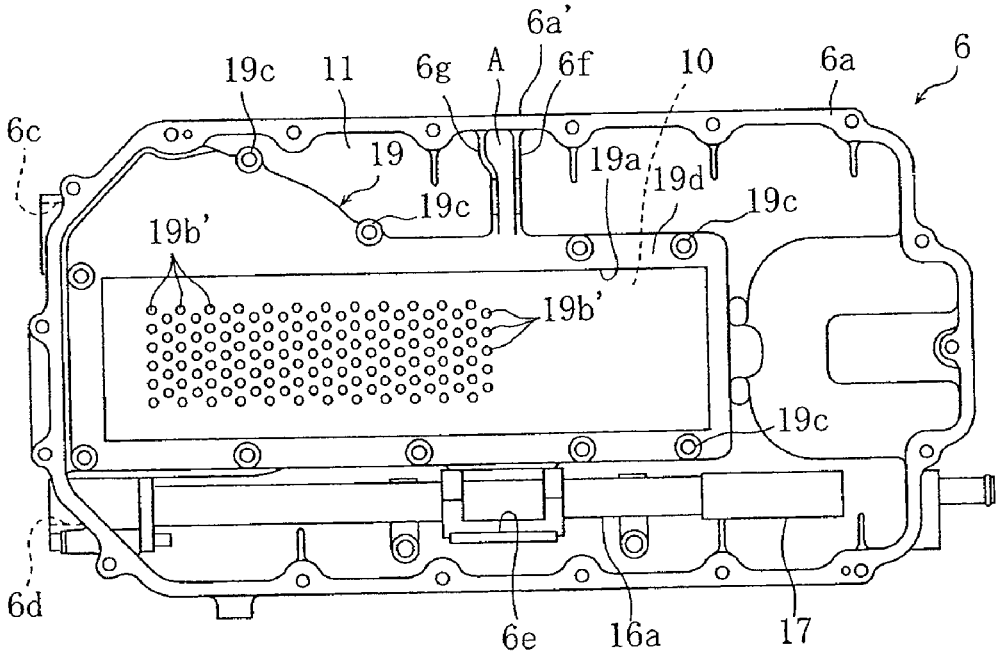

[FIG. 10]
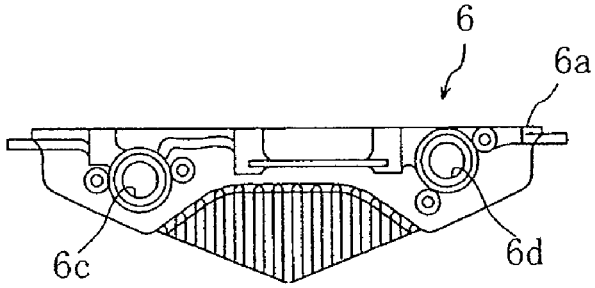
[FIG. 11]
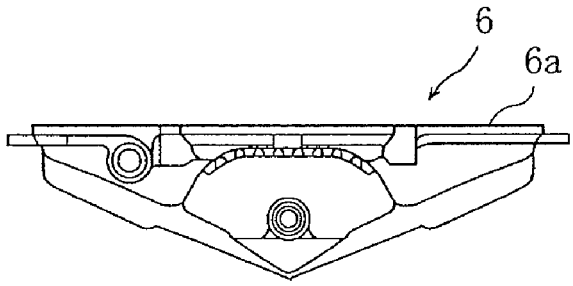
[FIG. 12]
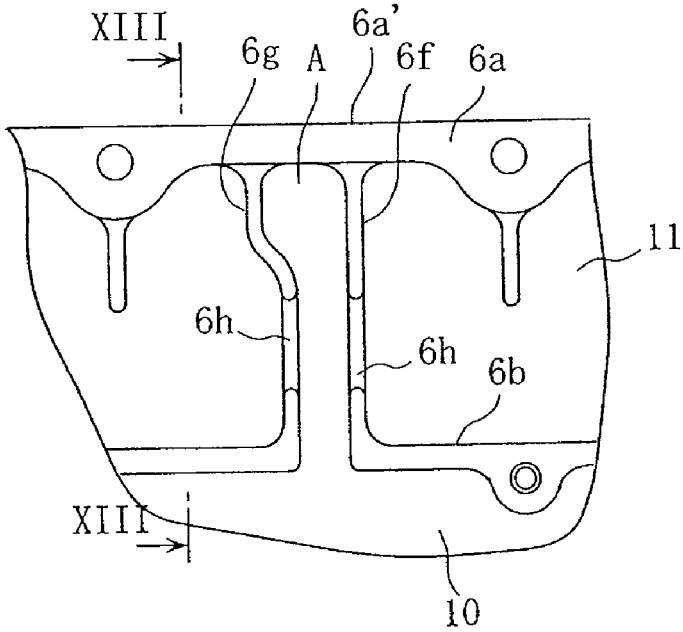

[FIG. 13]
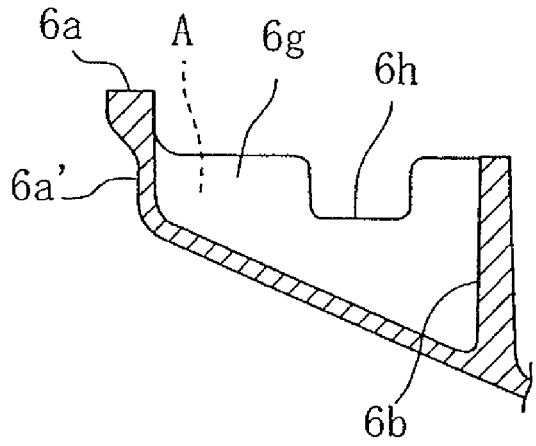
[FIG. 14]
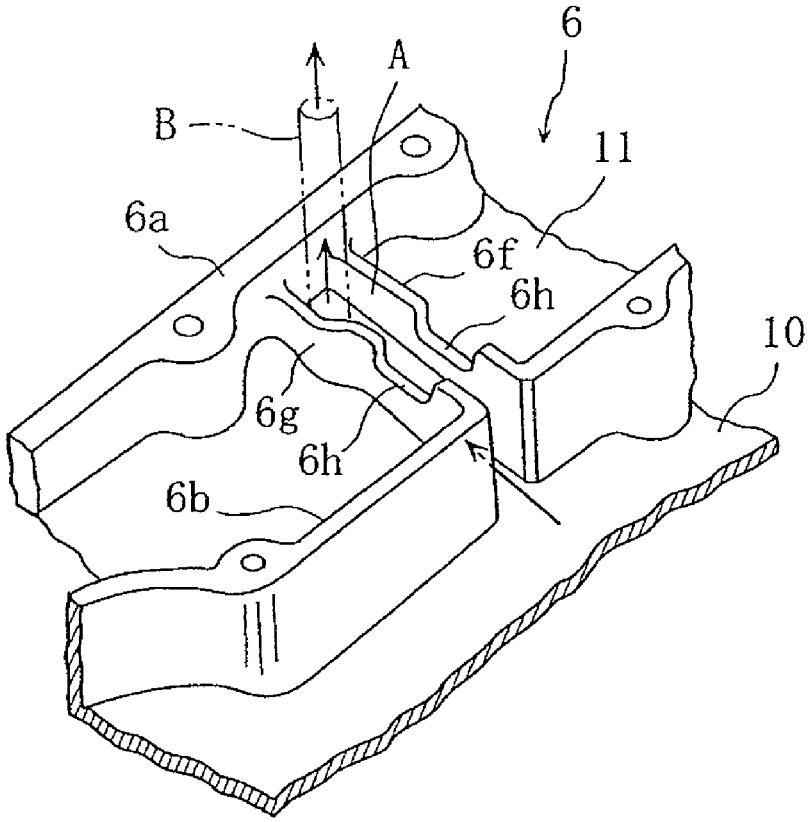

LUBRICATING APPARATUS FOR 4-CYCLE ENGINE

CROSS-REFERENCE TO RELATED APPLICATIONS

This application claims the priority benefit of Japanese Patent Application No. 2006-146997, filed May 26, 2006 and Japanese Patent Application No. 2007-036582, filed Feb. 16, 2007, which are hereby incorporated by reference in their entirety.

BACKGROUND OF THE INVENTION

1. Field of the Invention

The present invention generally relates to a lubricating apparatus for a 4-cycle engine suitable for a water vehicle and, more particularly, to a lubricating apparatus that provides a more consistent flow rate of lubricant and that is less likely to result in air entrainment by an lubricant pump even during a turn.

2. Description of the Related Art

Conventionally, a wet sump type (see Patent Document 1) and a dry sump system are used as a lubricating apparatus for a water vehicle having a 4-cycle engine. JP-A-Hei 08-49596 discloses a wet sump type of construction.

SUMMARY OF THE INVENTION

In a case of the wet sump type, it is necessary to ensure a sufficient capacity of an oil pan installed below a crankcase. However, with water vehicles, due to the smaller engine compartments, oil pans are shallow and wide. Because watercraft turns can continue for a long time (for example, one minute or more), unlike an automobile or others, oil in an oil pan tends to gather on a side corresponding to an outside of the turn for a prolonged time. In other words, an oil surface is easily inclined against an oil pan. As a result, air may be drawn into an oil intake opening of a feed pump. In order to provide sufficient oil to adequately cover the oil intake opening even when the oil surface is inclined, the oil pan size must be increased, which also results in a weight increase.

As shown in FIG. 1 of JP-A-Hei 08-49596, a rib is defined on a bottom section of an oil pan to divide an oil pan into a multiplicity of areas so that the oil is less likely to be unevenly distributed. However, because multiple areas are connected to each other via a part of a rib, oil in a oil pan gradually gathers to a side of the oil pan that is positioned on the outside of the turn if the turn continues for a long time as mentioned above.

Accordingly, a dry sump system is often adopted for a water vehicle to avoid the problem. In a case of a dry sump system, because an oil tank is independent of others, its shape has a high degree of freedom. A shape to ensure a capacity of an oil tank and to make air absorption less likely is possible. However, in a case of a dry sump system, it is necessary to pressurize and pump the oil from a bottom section of a crankcase to an oil tank. Hence, a large scavenging pump is necessary.

A system is desired that would provide a lubricating apparatus for a 4-cycle engine without increasing the minimum amount of oil necessary to reduce the likelihood of air entrainment in the oil during turns or the like and without upsizing an oil collecting pump.

BRIEF DESCRIPTION OF THE DRAWINGS

These and other features, aspects and advantages of the present invention will now be described with reference to the drawings of a preferred embodiment, which embodiment is intended to illustrate and not to limit the invention.

FIG. 1 is a cross sectional side view of a 4-cycle engine having a lubricating apparatus according to a first embodiment of the present invention.

FIG. 2 is a plan view of an oil pan of the lubricating apparatus of FIG. 1.

FIG. 3 is a plan view of the oil pan of FIG. 2 with a lid.

FIG. 4 is a cross sectional rear view of the lubricating apparatus showing the engine stopped.

FIG. 5 is a cross sectional rear view of the lubricating apparatus showing the engine in operation.

FIG. 6 is a cross sectional rear view of the lubricating apparatus during a left turn.

FIG. 7 is a cross sectional rear view of the lubricating apparatus during a right turn.

FIG. 8 is a plan view of an oil pan of a lubricating apparatus according to a second embodiment of the present invention.

FIG. 9 is a plan view of the oil pan of FIG. 8 with a lid.

FIG. 10 is a front view of the oil pan of FIG. 8.

FIG. 11 is a rear view of the oil pan of FIG. 8.

FIG. 12 is an enlarged plan view of an oil drain groove portion of the oil pan of FIG. 8.

FIG. 13 is a cross sectional view taken along the line XIII-XIII of FIG. 12 showing a notch of the oil drain groove portion of the oil pan.

FIG. 14 is a perspective view of the oil drain groove portion of the oil pan.

DETAILED DESCRIPTION OF THE PREFERRED EMBODIMENT

FIG. 1 to FIG. 7 illustrates a lubricating apparatus for a 4-cycle engine according to a first embodiment of the present invention. As illustrated in FIG. 1, the engine 1 preferably is a four-cylinder water-cooled 4-cycle type.

The engine 1 has a cylinder block 2, a cylinder head 3 connected to an upper joint surface of a cylinder section 2*a* of the cylinder block 2, and a head cover 4 attached to an upper joint surface of the cylinder head 3. In addition, an upper case section 2*b* forming an upper half section of a crankcase can be integrally formed and joined to a lower part of the cylinder section 2*a* of the cylinder block 2. A lower case 5 forming a lower half section of a crankcase can be connected to the lower joint surface of the upper case section 2*b*. Furthermore, an oil pan 6 can be connected to the lower joint surface of the lower case 5.

Pistons 7 arranged to freely slide in each of four cylinder bores 2*c* formed in the cylinder block 2 can be connected to a crankshaft 9 via a connecting rod 8. The crankshaft 9 has four crankpin sections 9*a* with one formed for each cylinder bore 2*c* and journal sections 9*b* formed to be positioned on both sides of each crankpin section 9*a*. The crankpin section 9*a* is arranged in a position shifted in a radial direction from the journal section 9*b*, and the crankpin section 9*a* and the journal section 9*b* are integrally connected by crank arm sections 9*c*, 9*c*. A weight section 9*d* is formed on a side opposite to the crank arm sections 9*c*, 9*c*. The crankpin section 9*a*, the crank arm section 9*c*, and the weight section 9*d* are arranged in the crankcase portion independently formed for each cylinder bore below each cylinder bore 2*c*.

The journal section 9*b* is supported by an upper bearing wall section 2*d* formed to extend downward from each cylinder bore boundary of the upper case section 2*b* and a lower bearing wall 5*a* formed to extend upward from the bottom wall 5*g* (see FIG. 4) of the lower case 5. The crankcase portion (a) preferably is a case surrounded with the side wall 2*b*' of the upper case section 2*b*, the bottom wall 5*g* in a shape of an arc of the lower case 5, the upper bearing wall section 2*d*, the lower bearing wall section 5*a*, and others, and is formed to be a little larger than a rotation locus of the large end 8*a* of the connecting rod 8 and the weight section 9*d* of the crankshaft 9. Each crankcase portion (a) is connected with another via a communicating hole 2*d*' formed in the upper bearing wall section 2*d*.

As best shown in FIG. 4, for instance, the bottom wall 5*g* of the lower case 5 forms a bottom section of the crankcase (a) and functions as a baffle plate for reducing the likelihood that oil in the oil pan 6 will be agitated by the weight section 9*d* of the crankshaft 9 or other components. Oil openings 5*h* and 5*h*' for dropping oil in the crankcase (a) to the oil pan 6 are formed on the bottom wall 5*g*. In addition, a stopper section 5*i* can be formed to protrude upward on a downstream side peripheral section of the opening 5*h* positioned on an upstream side in a direction of a crankshaft rotation. This stopper section 5*i* functions to forcefully drop oil rotating in a direction of the arrow f with the crankshaft 9 into the opening 5*h*. In other words, the stopper section 5*i* redirects oil from a path driven by the weight section 9*d* of the crankshaft 9 into the opening 5*h*.

With reference again to FIG. 1, lubricating oil is provided to the crankpin section 9*a* and the journal section 9*b* of the crankshaft 9 by a feed pump (oil supply pump) 15 mentioned below via an oil hole 9*e* formed in the crankshaft 9, and the provided oil drops into the crankcase (a).

In addition, a crank sprocket 9*f* of a camshaft drive mechanism is formed at a front-end section of the crankshaft 9. Although not shown in the drawing, the crank sprocket 9*f* is connected to a cam sprocket of intake camshaft and exhaust camshaft sides by a cam chain. The cam chain is arranged in a chain case (b) formed at a front-end section of the engine. The chain case (b) is formed with a chain hole 2*e* formed at a front section of the cylinder block 2 and a gear case 5*b* formed at a front-end section of the lower case 5, and an opening 5*c* is formed in a bottom wall of the gear case 5*b*. As mentioned above, the camshaft housing case 3*a* of the cylinder block 3 and an inside of the oil pan 6 are connected with each other by the chain case (b).

The illustrated oil pan 6 is generally dish-shaped and, in one configuration, is generally rectangular in plan view. In one configuration, its upper joint surface 6*a* is detachably fixed on the lower joint surface 5*d* of the lower case 5 by fastening bolts. The oil pan 6 can be divided into a main oil chamber 10 and an auxiliary oil chamber 11 by one or more dividing walls 6*b*. The left and right walls 5*i* of the lower case 5 form at least two oil reserve sections 5*f*, 5*f* extending generally in a direction of a crankshaft by extending upward from the lower joint surface 5*d* and surrounding each crankcase (a) from left and right sides.

The main oil chamber 10 is an oil chamber for collecting a majority of the oil returning from a lubricated section, such as the crankpin section 9*a*, the journal section 9*b*, a bearing section of the camshaft, or others, and to provide the collected oil to the lubricated section. The illustrated auxiliary oil chamber 11 is an oil chamber arranged to generally surround at least three sides of the main oil chamber 10, which are left, right, and rear sections in the illustrated embodiment. The auxiliary oil chamber collects a part of the oil returning from lubricating the lubricated section. The oil collected in the auxiliary oil chamber is returned to the main oil chamber 10 via a vapor-liquid separation chamber 12. In other words, the illustrated main oil chamber 10 is positioned at a center of a transverse direction of the oil pan 6, and the auxiliary oil chamber 11 is positioned to the left and right side sections of the main oil chamber 10.

A front half section on a right side of the dividing wall 6*b* extends to a side of the auxiliary oil chamber 11 and an oil return section 6*e* is formed to protrude to a side of the auxiliary oil chamber 11 at a center section of a left side of the dividing wall 6*b*. In the main oil chamber 10, an intake pipe 13 is arranged. An oil strainer 14 installed to the rear end section 13*a* of the intake pipe 13 is positioned in a rear half section of the front-rear direction of the main oil chamber 10, defining an opening. In the illustrated embodiment, the front-end section 13*b* of the intake pipe 13 is bent to a right side along a front half section on a right side of the dividing wall 6*b*, and connected with an external connecting opening 6*c* formed in a front wall section of the oil pan 6. A feed pump (oil supply pump) 15 for supplying oil to the lubricated section can be connected to the external connecting opening 6*c*, and the feed pump 15 supplies oil to one or more of the lubricated sections.

Left and right intake pipes 16*a* and 16*b* preferably are arranged in the auxiliary oil chamber 11, positioned in left and right sections of the main oil chamber 10 respectively, and an oil strainer 17, which is connected with rear end sections of the left and right intake pipes, can be positioned in a rear end section of a front-rear direction of the auxiliary oil chamber 11.

The left intake pipe 16*a* goes through the oil return section 6*e* of the dividing wall 6*b* in a front-rear direction. In addition, the front section 16*c* of the right intake pipe 16*b* is joined to the left intake pipe 16*a*, crossing the main oil chamber 10. The front-end section of the left intake pipe 16*a* is connected with an external connecting opening 6*d* formed in a front wall section of the oil pan 6. A scavenging pump (oil collecting pump) 18 to return oil in the auxiliary oil chamber 11 to the main oil chamber 10 via the vapor-liquid separation chamber 12 is connected with the external connecting opening 6*d*.

With reference to FIG. 4, the vapor-liquid separation chamber 12 can be formed or positioned on an outside of the side wall 2*b*' of the cylinder block 2. In the illustrated configuration, the vapor-liquid separation chamber 12 is connected with the oil return section 6*e* of the main oil chamber 10 via a return hole 12*a* formed in the bottom section of the vapor-liquid separation chamber 12, the oil hole 5*e* formed in the lower case 5, and an oil path 5*f*', formed to penetrate the oil reserve section 5*f* on a left side in a top-bottom direction. The oil path 5*f*' is made by dividing in axial direction of the crankshaft with dividing walls an inside of the oil reserve section 5*f*. The oil path 5*f*' is connected by the oil return section 6*e* of the dividing wall 6*b* to the main oil chamber 10. Viewed in a direction of the crankshaft 9, the crankshaft 9 is positioned above the main oil chamber 10, which is inside of the dividing walls 6*b*, 6*b*. Preferably, the crankshaft 9 is positioned above a rearward portion of the main oil chamber 10.

A lid 19 can be arranged to overlie at least a portion of an opening of the main oil chamber 10. The lid 19 can be removably secured with a bolt 19*c* such that the lid 19 can be attached and detached. The lid 19 preferably has generally the same shape as a shape of a top view of the dividing wall 6*b*, which forms a boundary between the main oil chamber 10 and the auxiliary oil chamber 11. A concave section 19*a* extending in the axial direction of the crankshaft can be formed on the lid 19 such that the lid 19 bows slightly downward in a cross-sectional view (see FIG. 4), and a generally flat peripheral section 19*d* can be formed around the concave section 19*a*. Multiple groups (e.g., six groups in the illustrated example), of multiple oil collecting holes 19*b* (e.g., three in the illustrated example) can be formed inward from an outer peripheral section of the main oil chamber 10. In one configuration, the holes 19*b* can be spaced from the outer peripheral section by a width of the flat peripheral section 19*d*. Four groups of the six groups of oil collecting holes 19*b* can be arranged such that they are positioned generally directly below (e.g., overlapping in plan view) the journal section 9*b* and the other two groups can be arranged generally directly below (e.g., overlapping in plan view) the opening 5*c* of the lower case 5.

The lid 19 preferably is separately formed as a component relative to the main oil chamber 10, but the lid 19 can be integrally formed with the main oil chamber 10 in some embodiments.

As shown in FIG. 4, in a state where the engine 1 in the embodiment remains stopped, the engine oil stays in all sections from a bottom of the crankcase (a) to the oil pan 6. The oil surface L is set to a height where the weight section 9*d* of the crankshaft 9 is a little under the oil surface when the piston 7 is at a compression top dead center. In this case, the oil surface L is in a position higher than the lid 19 of the main oil chamber 10.

In a state where a straightforward navigation is made by driving the engine 1, the feed pump 15 collects the oil in the main oil chamber 10 and supplies it to lubricated sections such as the crankshaft 9 and a bearing of a camshaft, and the scavenging pump 18 collects the oil in the auxiliary oil chamber 11 and sends it to the vapor-liquid separation chamber 12. Oil having lubricated a lubricated section, such as the crankshaft 9, drops (see the arrows (d) in FIG. 5) from the crankcase (a) to the main oil chamber 10, and oil having lubricated a lubricated section, such as a bearing of a camshaft, drops from the chain case (b) to the main oil chamber 10 or the auxiliary oil chamber 11. Oil from which air is separated and removed in the vapor-liquid separation chamber 12 returns (see the arrow (e) in FIG. 5) to the main oil chamber 10. As a result, as shown in FIG. 5, oil fills the vapor-liquid separation chamber 12, the oil reserve section 5*f* on the left side, and sections between them; and the oil surface L' is generally below the crankcase (a) in a state where the oil surface L' is proximate the lid 19 of the main oil chamber 10.

Accordingly, oil is not agitated by a rotation of the crankshaft 9 during ordinary straightforward navigation, so that the likelihood of output loss due to oil agitation is greatly reduced.

When a left turn is made, oil shifts to the right side, which is an opposite direction of a turn, because of centrifugal force. As shown in FIG. 6, the oil surface L inclines in a manner where a right side of the cylinder axis line C in the drawing is relatively higher. In the embodiment, because an oil amount is sufficiently ensured, the oil strainer 14 of the intake pipe 13 is sufficiently under oil, so that air absorption does not occur. Even when an oil amount is reduced a great deal, such as the oil surface L', which is indicated by a broken line in the drawing, the intake pipe 13 is under oil, so that air absorption is less likely to occur. In other words, because the oil chamber is divided into the main oil chamber 10 and the auxiliary oil chamber 11 and the main oil chamber 10 is covered by the lid 19, when a left turn is made, the oil surface L' passes the right periphery of the oil collecting hole 19*b* and becomes generally parallel with the oil surface L, and the intake pipe 13 does not easily become uncovered by the oil, so that air absorption is less likely to occur. When a right turn is made, as shown in FIG. 7, the oil surface L inclines in a manner where a left side is higher. However, air absorption does not easily occur as in a case of a left turn as shown in FIG. 6.

Because the oil chamber is divided into the main oil chamber 10 and the auxiliary oil chamber 11, the main oil chamber 10 is connected with the feed pump 15, and the auxiliary oil chamber 11 is connected with the scavenging pump 18, oil collection is conducted mainly by the main oil chamber 10, and oil not collected by the main oil chamber 10 (for example, oil spilled from the main oil chamber) is collected by the auxiliary oil chamber 11 and returned to the main oil chamber 10. Thus, the oil surface of the main oil chamber 10 is maintained in a high position such that air absorption does not easily occur even when the oil surface inclines greatly, such as during a turn.

In addition, it is not necessary to increase an amount of oil such that a weight increase and an upsizing of an oil pan can be avoided. Because excess oil having flowed out of the main oil chamber 10 during a left or right turn flows into the auxiliary oil chamber 11, the oil surface does not exceed a top end of the main oil chamber 10. Such a construction reduces the likelihood of the crankshaft agitating the oil.

In addition, because the scavenging pump 18 collects only oil in the auxiliary oil chamber 11, a scavenging pump 18 need not be increased in capacity.

Because the main oil chamber 10 is positioned right below the crankshaft 9, oil leaking from a lubricated section is more likely to be received by the main oil chamber.

Furthermore, because the main oil chamber 10 is installed toward a center section in the transverse direction of the oil pan 6 and the auxiliary oil chamber 11 is installed to both transverse sides of the main oil chamber 10, oil flowing out of the main oil chamber 10 into the left side and the right side is collected.

Because the cam chain case (b) is adjacent to the crankcase (a) and the cam chain case (b) is connected with the main oil chamber 10, oil flowing down the cam chain case (b) also is directly collected in the main oil chamber 10 so that the oil collecting path is simplified.

The main oil chamber 10 can be covered with the lid 19, which includes the oil collecting holes 19*b*. Such a construction suppresses oil in the main oil chamber 10 from flowing out of the main oil chamber 10, for example, when it splashes. Therefore, it is easy to maintain a sufficient oil level within the main oil chamber 10. In addition, such a construction suppresses oil flowing into the crankcase (a) in a case of an overturn or the like.

Because the oil collecting hole 19*b* is positioned away from an outer periphery of the lid 19 by the width of the flat peripheral section 19*d*, the oil surface L' can incline up to the same level as a tangent of a feed pump intake opening (e.g., the oil strainer 14) passing an outer periphery of rotation of the oil collecting hole 19*b*, so that air absorption is less likely to occur.

Because the concave section 19*a*, which bows downward toward the bottom, is formed on the lid 19 and the oil collecting hole 19*b* is formed in the concave section 19*a*, oil having dropped out of the crankcase (a) is received by the concave section 19*a*, flows to the oil collecting hole 19*b* and to the main oil chamber 10, which improves oil collection.

Because the oil collecting hole 19*b* is positioned below the journal section 9*b* of the crankshaft 9 in a plan view, which is a section other than the crank arm section 9*c* or the weight section 9, oil having flowed out of the main oil chamber 10 through the oil collecting hole 19*b* is not easily scooped up by the weight section 9*d* or other portions of the crankshaft 9.

Because intake openings of the feed pump 15 and the scavenging pump 18 (e.g., the oil strainers 14 and 17) open in a position rearward from a center of the front-rear direction of the main oil chamber 10 and the auxiliary oil chamber 11, air absorption is less likely to occur. In other words, because of the structure mentioned above, oil is surely absorbed during navigation and air absorption is less likely to occur even when used in a water vehicle or the like, which moves and navigates in a position with a front side raised, and in which oil tends to gather on a rear side.

Because a portion of oil having lubricated a lubricated section, such as a camshaft, flows into the auxiliary oil chamber 11, a path for an oil return is simplified.

FIG. 8 to FIG. 14 illustrate a second embodiment of the present invention in which similar or corresponding parts are denoted by the same reference numerals as in FIG. 1 to FIG. 7. In the second embodiment, an oil drain groove (A) is formed for draining oil in the main oil chamber 10 to the outside. The oil drain groove (A) guides oil in the main oil chamber 10 to an area immediately below an insertion hole for an oil level gauge. The oil drain groove (A) communicates with the inside of the main oil chamber 10, and is closed by an outer wall 6*a*' surrounding the auxiliary oil chamber 11.

Specifically, groove walls 6*f*, 6*g*, as parts of the dividing wall 6*b* surrounding the main oil chamber 10, extend toward and are connected to the outer wall 6*a*'. The oil drain groove (A) is formed to pass across the auxiliary oil chamber 11. Oil is drained from a part of the oil drain groove (A) on the outer wall 6*a*' side, which is located generally immediately below the insertion hole for the oil level gauge for checking the oil level.

As shown in FIG. 14, to drain oil, an oil drain tube (B) is inserted into the insertion hole for the oil level gauge, instead of the oil level gauge, to allow an oil pump or the like to drain oil in the main oil chamber 10 through the tube (B).

With the oil drain groove (A) for guiding oil in the main oil chamber 10 to an area generally immediately below the oil level gauge insertion hole, oil can be changed through the oil level gauge insertion hole, thus eliminating the need to provide an oil drain plug or the like at the bottom of the oil pan.

The groove walls 6*f*, 6*g* defining the oil drain groove (A) can be formed with notches 6*h*, 6*h* extending downward from the upper edge of the groove walls 6*f*, 6*g*. The notches 6*h*, 6*h* allow oil in the auxiliary oil chamber 11 to flow back and forth across the oil drain groove (A), thus reducing the likelihood that a dead space in the auxiliary oil chamber 11 will be created due to the existence of the oil drain groove (A).

Providing the notch 6*h* may cause oil in the main oil chamber 10 to leak out to the auxiliary oil chamber 11. However, in one preferred embodiment, the notch 6*h* has a minimum size that allows oil in the auxiliary oil chamber 11 to flow back and forth across the oil drain groove (A). Thus, only a small amount of oil leaks out as described above, and so providing the notch 6*h* makes it less likely that an oil pump will suck air even during turns even without an increase in the overall amount of oil.

Also, in the second embodiment, oil collecting holes 19*b*' are formed in a front portion of the lid 19, more specifically, in a portion of the lid 19 forward of the oil strainer 14, which serves as an intake opening of the feed pump 15.

When a water vehicle to which the present invention pertains is running, the front part of the water vehicle is raised and oil in the main oil chamber tends to be shifted to the oil strainer 14 side. So, if the oil collecting holes 19*b*' are located at a part of the lid 19 on the oil strainer 14 side, there is a possibility that the shifted oil may leak out of the main oil chamber 10 through the oil collecting holes 19*b*'. In this embodiment, however, the oil collecting holes 19*b*' are formed specifically on the front side, thus reducing the likelihood of oil leakage, such as that described above.

The first and second embodiments mentioned above describe a lubricating apparatus of a 4-cycle engine for a water vehicle. However, it is understood that the present invention can be applied not only to an engine for a water vehicle but also to other 4-cycle engines for, for example, an automobile or a motorcycle.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A lubricating apparatus for a 4-cycle engine comprising an oil pan, the oil pan defining an oil chamber configured to collect oil that has lubricated a lubricated section, the oil chamber being positioned generally vertically below a crankcase, the oil chamber of the oil pan being divided into a main oil chamber connected to the crankcase and an auxiliary oil chamber adjacent to the main oil chamber, the main oil chamber being configured to collect oil having dropped from the crankcase;

the main oil chamber being fluidly connected to an oil supply pump that delivers oil to the lubricated section; and the auxiliary oil chamber being fluidly connected to an oil collecting pump that returns oil to the main oil chamber without lubrication moving parts of the engine.

2. The apparatus of claim 1 wherein a crankshaft is positioned above the main oil chamber at a transverse location defined within a first and second lateral wall that at least partially defines the main oil chamber.

3. The apparatus of claim 2, wherein at least a portion of the main oil chamber is covered with a lid and the lid comprises an oil collecting hole.

4. The apparatus of claim 3, wherein a baffle plate is arranged on a lower part of the crankcase; and the oil collecting hole is positioned below a journal section of a crankshaft in plan view.

5. The apparatus of claim 3, wherein at least a part of the lid is concave toward a bottom side.

6. The apparatus of claim 3, wherein the oil collecting hole is positioned away from a periphery of the lid.

7. The apparatus of claim 6, wherein at least a part of the lid is concave toward a bottom side.

8. The apparatus of claim 2, wherein a cam chain case is adjacent to the crankcase, and the cam chain case is fluidly connected to the main oil chamber.

9. The apparatus of claim 8, wherein at least a portion of the main oil chamber is covered with a lid and the lid comprises an oil collecting hole.

10. The apparatus of claim 9, wherein at least a part of the lid is concave toward a bottom side.

11. The apparatus of claim 9, wherein the oil collecting hole is positioned away from a periphery of the lid.

12. The apparatus of claim 11, wherein at least a part of the lid is concave toward a bottom side.

13. The apparatus of claim 2, wherein the main oil chamber is disposed to a center section of the transverse direction of the oil pan, and the auxiliary oil chamber is disposed to both transverse sides of the main oil chamber.

14. The apparatus of claim 13, wherein at least a portion of the main oil chamber is covered with a lid and the lid comprises an oil collecting hole.

15. The apparatus of claim 14, wherein at least a part of the lid is concave toward a bottom side.

16. The apparatus of claim 14, wherein the oil collecting hole is positioned away from a periphery of the lid.

17. The apparatus of claim 16, wherein at least a part of the lid is concave toward a bottom side.

18. The apparatus of claim 16, wherein a cam chain case is adjacent to the crankcase, and the cam chain case is fluidly connected to the main oil chamber.

19. The apparatus of claim 18, wherein at least a portion of the main oil chamber is covered with a lid and the lid comprises an oil collecting hole.

20. The apparatus of claim 19, wherein at least a part of the lid is concave toward a bottom side.

21. The apparatus of claim 19, wherein the oil collecting hole is positioned away from a periphery of the lid.

22. The apparatus of claim 21, wherein at least a part of the lid is concave toward a bottom side.

23. The apparatus of claim 1, wherein the main oil chamber is disposed to a center section of the transverse direction of the oil pan, and the auxiliary oil chamber is disposed to both transverse sides of the main oil chamber.

24. The apparatus of claim 23, wherein at least a portion of the main oil chamber is covered with a lid and the lid comprises an oil collecting hole.

25. The apparatus of claim 24, wherein at least a part of the lid is concave toward a bottom side.

26. The apparatus of claim 24, wherein the oil collecting hole is positioned away from a periphery of the lid.

27. The apparatus of claim 26, wherein at least a part of the lid is concave toward a bottom side.

28. The apparatus of claim 26, wherein a cam chain case is adjacent to the crankcase, and the cam chain case is fluidly connected to the main oil chamber.

29. The apparatus of claim 28, wherein at least a portion of the main oil chamber is covered with a lid and the lid comprises an oil collecting hole.

30. The apparatus of claim 28, wherein at least a part of the lid is concave toward a bottom side.

31. The apparatus of claim 29, wherein the oil collecting hole is positioned away from a periphery of the lid.

32. The apparatus of claim 31, wherein at least a part of the lid is concave toward a bottom side.

33. The apparatus of claim 1, wherein a cam chain case is adjacent to the crankcase, and the cam chain case is fluidly connected to the main oil chamber.

34. The apparatus of claim 33, wherein at least a portion of the main oil chamber is covered with a lid and the lid comprises an oil collecting hole.

35. The apparatus of claim 34, wherein at least a part of the lid is concave toward a bottom side.

36. The apparatus of claim 34, wherein the oil collecting hole is positioned away from a periphery of the lid.

37. The apparatus of claim 36, wherein at least a part of the lid is concave toward a bottom side.

38. The apparatus of claim 1, wherein an intake opening of the oil supply pump and an intake opening of the oil collecting pump are opened in a rearward portion of the main oil chamber and the auxiliary oil chamber, respectively.

39. The apparatus of claim 1, wherein a portion of oil that lubricated the lubricated section flows into the auxiliary oil chamber.

40. The apparatus of claim 1 additionally comprising a vapor-liquid separator chamber fluidly connected to the main oil chamber, the oil collecting pump being fluidly connected to the vapor-liquid separator chamber so to deliver oil from the auxiliary oil chamber to the vapor-liquid separator chamber.

* * * * *